US009120640B2

(12) United States Patent
Janosik et al.

(10) Patent No.: US 9,120,640 B2
(45) Date of Patent: Sep. 1, 2015

(54) COLLAPSIBLE WIRE CARRIER

(71) Applicant: L&P Property Management Company, South Gate, CA (US)

(72) Inventors: Mark J. Janosik, Beechgrove, TN (US); Karl L. VanBecelaere, Nashville, TN (US)

(73) Assignee: L&P Property Management Company, South Gate, CA (US)

( * ) Notice: Subject to any disclaimer, the term of this patent is extended or adjusted under 35 U.S.C. 154(b) by 280 days.

(21) Appl. No.: 13/721,220

(22) Filed: Dec. 20, 2012

(65) Prior Publication Data

US 2014/0175203 A1 Jun. 26, 2014

(51) Int. Cl.

| | |
|---|---|
| ***B65H 75/12*** | (2006.01) |
| ***B65H 75/20*** | (2006.01) |
| ***B65H 75/22*** | (2006.01) |
| ***B65H 7/20*** | (2006.01) |

(52) U.S. Cl.

CPC ..... *B65H 75/22* (2013.01); *B65H 7/20* (2013.01); *B65H 75/12* (2013.01); *B65H 2701/36* (2013.01)

(58) Field of Classification Search

CPC ..... B65H 75/12; B65H 75/20; B65H 75/22
USPC ..... 242/604, 604.1, 118.1, 607, 608, 608.4, 242/608.5, 609.2, 609.3, 407.1
See application file for complete search history.

(56) References Cited

U.S. PATENT DOCUMENTS

| | | | | |
|---|---|---|---|---|
| 3,000,589 | A * | 9/1961 | Patterson | 242/577.2 |
| 3,021,010 | A | 2/1962 | McMasters | |
| 3,041,001 | A | 6/1962 | Feifert | |
| D197,393 | S | 1/1964 | Beltram | |
| 3,127,018 | A | 3/1964 | McMasters | |
| 3,127,127 | A | 3/1964 | Kohn et al. | |
| 3,139,986 | A | 7/1964 | Strock | |
| 3,186,658 | A * | 6/1965 | Kohn et al. | 242/129 |
| 3,464,647 | A | 9/1969 | Jacobi | |
| 6,276,631 | B1 | 8/2001 | Mio et al. | |
| 6,908,060 | B2 * | 6/2005 | Hibbs | 242/578.2 |
| 2004/0207220 | A1 * | 10/2004 | Adams et al. | 294/67.1 |
| 2008/0277933 | A1 * | 11/2008 | Church | 285/334 |

FOREIGN PATENT DOCUMENTS

JP 2000342352 A * 12/2000

* cited by examiner

*Primary Examiner* — William E Dondero
(74) *Attorney, Agent, or Firm* — Wood, Herron & Evans, LLP

(57) ABSTRACT

A collapsible wire carrier (10) includes a base (12) and a top (24) spaced from each other with a plurality of tubular legs (32). The legs (32) are secured to the base (12) and the top (24) with connectors (36) using fasteners (40). Each leg (32) has openings (34) at each end which, upon assembly, are aligned with openings (38) in connectors (36) and secured thereto with fasteners (40). Four connectors (36) fit inside portions of the base (12) and inside portions of the legs (32). Four other connectors (36) fit inside portions of the top (24) and inside portions of the legs (32).

18 Claims, 6 Drawing Sheets

COLLAPSIBLE WIRE CARRIER

FIELD OF THE INVENTION

This invention relates generally to wire carriers and, more particularly, to collapsible wire carriers for use in winding and unwinding, transporting and storing coils of wire.

BACKGROUND OF THE INVENTION

A conventional carrier for a coil of wire consists of a plurality of vertically positioned rods or tubes in spaced relation on a disc-shaped base. The rods or tubes are joined to the base and at the top of the carrier to one another by welding. Wire carriers of this type are completed at a fabricating plant, and stacked together by nesting for storing and shipping. While a number of these carriers may be nested to form a relatively compact unit or package, the nested packages are difficult to handle and store. In order to be stored or shipped, they require an excessive amount of space, thus increasing the cost of shipping and storage. Further, this type of carrier is necessarily made relatively heavy and bulky in order to obtain the requisite amount of strength, particularly in the disc base.

U.S. Pat. No. 3,186,658 discloses a tubular collapsible wire carrier. However, this collapsible wire carrier has a "four leaf clover" base which may easily become caught on objects in a factory and cause damage. Furthermore, even when collapsed, the pieces of this collapsible wire carrier are relatively large and bulky and may be difficult to transport. If a forklift damages one of the legs of this collapsible wire carrier, at least two legs must be replaced.

Thus, there is a need for a tubular collapsible wire carrier which has legs which may be individually replaced if damaged.

There is further a need for a tubular collapsible wire carrier which may be broken down in more pieces than known collapsible wire carriers.

SUMMARY OF THE INVENTION

This invention comprises a collapsible wire carrier for storing and shipping wire. One embodiment of collapsible wire carrier comprises a base, a top and multiple legs, each leg being removably secured to the base and top of the carrier. The base may include multiple base extensions welded or otherwise secured to a generally rectangular base bottom. In one embodiment, each of the legs is tubular. The top, base and each of the legs may have multiple openings therein through which fasteners pass. The collapsible wire carrier may further comprise multiple connectors for joining the legs to the base and top, each of the connectors joining one of the legs to one of the base and top. In one embodiment, each of the connectors fits inside a portion of one of the legs. The collapsible wire carrier further comprises fasteners for removably securing the connectors to the legs, top and base. Each of the fasteners extends through one of the openings in one of the base, top and legs and into a passage in one of the connectors.

According to another aspect of this invention, the collapsible wire carrier comprises a base, a top and multiple legs. In this embodiment, the top, base and each of the legs has threaded ends therein for receiving connectors. The collapsible wire carrier further comprises multiple connectors for joining the legs to the base and top. Four of the connectors join the legs to the base and four other connectors join the legs to the top. Each of the connectors has threaded ends for engaging the legs of the collapsible wire carrier. Each of the connectors thus removably secures the legs to one of the top and base.

DETAILED DESCRIPTION OF THE DRAWINGS

Figure 1:
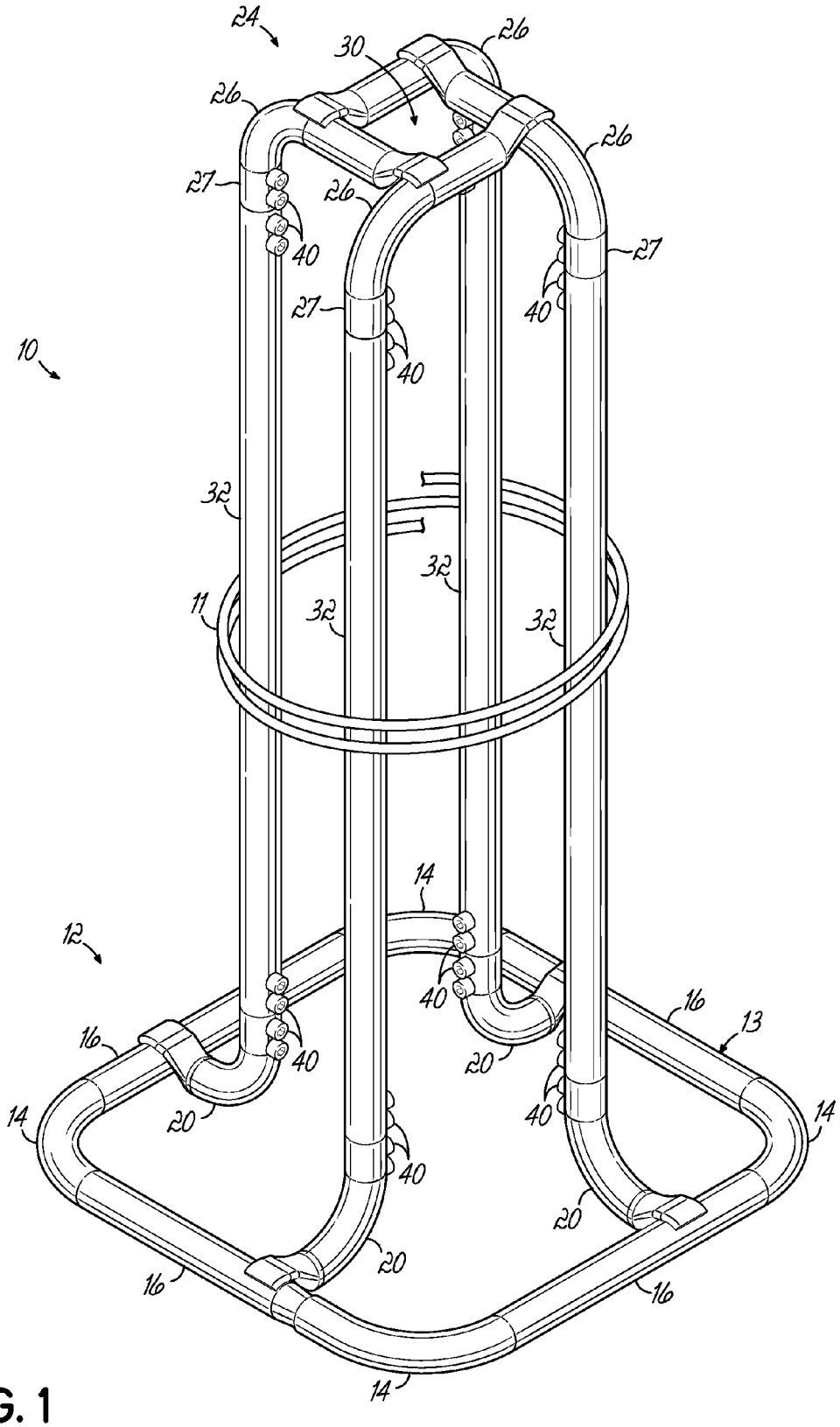
FIG. 1 is a perspective view of one embodiment of collapsible wire carrier in an assembled condition.

Referring to the drawings, and particularly to FIG. 1, there is illustrated a collapsible wire carrier 10 for storing and transporting wire 11. The collapsible wire carrier 10 comprises a base 12 having a generally rectangular base bottom 13 comprising four corner pieces 14 and four straight side pieces 16 (only one being shown per side in FIG. 1). Although the base bottom 13 shown in FIG. 1 shows each of the sides 18 of the base bottom 13 being approximately the same length, they may be any desired lengths. The drawings are not intended to be limiting. Each of the pieces 14, 16 of base 12 may be tubular and sized to fit together when assembled.

Figure 2:
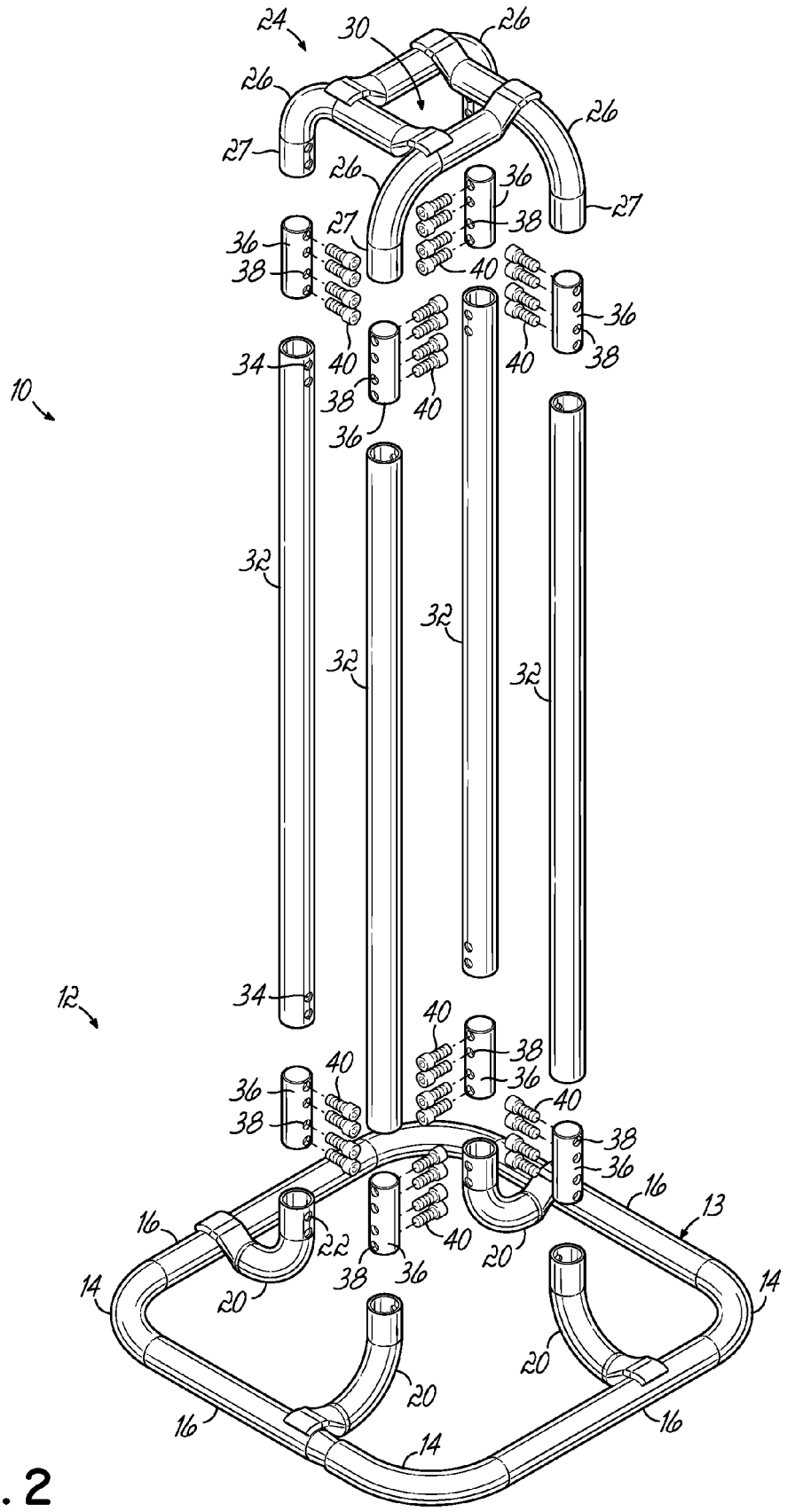
FIG. 2 is a partially disassembled view of the collapsible wire carrier of FIG. 1.

As best shown in FIG. 2, the base 12 of collapsible wire carrier 10 further comprises a plurality of tubular base extensions 20 secured to the side pieces 16 of the base bottom 13, such as by welding. Each of the base extensions 20 is arched or bowed upwardly and inwardly towards the center of the base bottom 13. As shown in FIG. 2, two circular openings 22 are located at an upper portion of each of the tubular base extensions 20. These openings 22 are directed inwardly towards the center of the base bottom 13. Although the openings 22 are shown having a certain circular configuration, they may be other sizes or shapes. Although two openings 22 are illustrated extending through the wall of the upper portion of each tubular base extension 20, any number of openings may be present.

As best shown in FIG. 2, collapsible wire carrier 10 further comprises a top 24 comprising four top members 26 welded together. Each of the top members 26 may be tubular and have a downwardly turned lower portion 27 having two openings 28 extending through the tube wall. These openings 28 are directed inwardly towards the center of the top 24. Although the openings 28 are shown having a certain circular configuration, they may be other sizes or shapes. Although two openings 28 are illustrated extending through the wall of the lower portion 27 of each tubular top member 26, any number of openings may be present. Each of the top members 26 is welded to one of the other top members 26 to create a rectangular opening 30 in the top 24, as shown in FIGS. 1 and 2.

As best shown in FIG. 2, collapsible wire carrier 10 further comprises four straight tubular legs 32. Each leg 32 has at each end two openings 34 extending through the tube wall. These openings 34 are directed inwardly towards the center of the collapsible wire carrier 10. Although the openings 34 are shown having a certain circular configuration, they may be other sizes or shapes. Although two openings 34 are illustrated extending through the wall of each tubular leg 32 at each end of the leg 32, any number of openings may be present at each end of each leg 32.

As best shown in FIG. 2, collapsible wire carrier 10 further comprises eight connectors 36. Four of the connectors 36 join upper portions of the legs 32 to the top 24 of the collapsible wire carrier 10 and, particularly, to the downwardly turned portions 27 of the top members 26. Four other of the connectors 36 join lower portions of the legs 32 to the base 12 of the collapsible wire carrier 10 and, particularly, to the tubular base extensions 20 of base 12.

Figure 3:
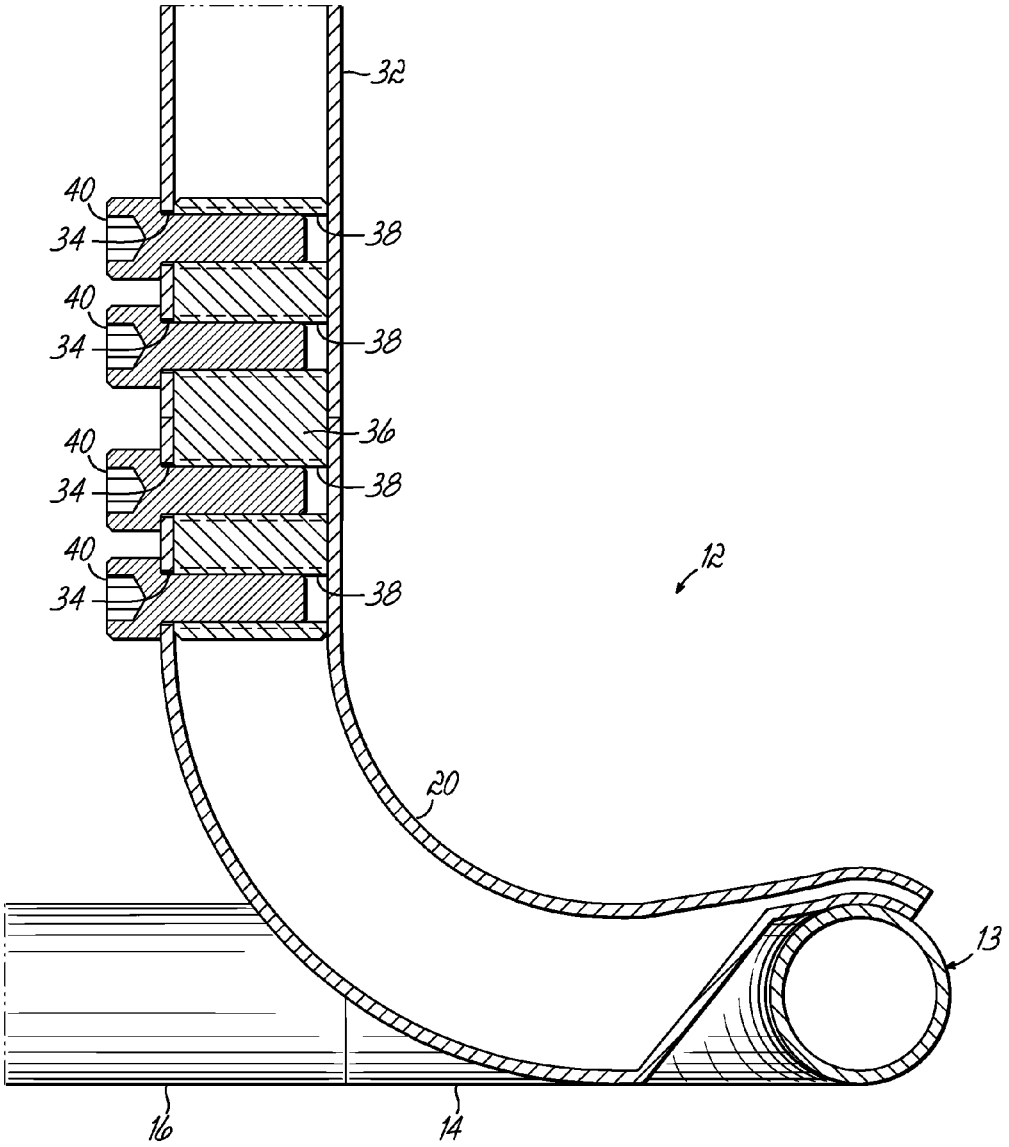
FIG. 3 is an enlarged cross-sectional view of a portion of the collapsible wire carrier of FIGS. 1 and 2.

As shown in FIG. 3, each of the connectors 36 is a solid metallic piece having four aligned threaded openings 38 therein. Each of the threaded openings 38 is sized and adapted to receive a threaded fastener 40. Although the fasteners 40 are illustrated as being set screws, they may be any other conventional fasteners.

As shown in FIG. 2, each of the four connectors 36 used to join the base 12 to the legs 32 fits partially inside one of the base extensions 20 and partially inside a lower portion of one of the legs 32. The lower two openings 38 of each of these four connectors 36 align with the two openings 22 of one of the base extensions 20 so that two fasteners 40 may extend through two of the openings 22 of a base extension 20 and extend into the two of the openings 38 of a connector 36. Similarly, the upper two openings 38 of each of these four connectors 36 align with the two openings 34 of one of the legs 32 so that two fasteners 40 may extend through the openings 34 of a leg 32 and extend into the two of the openings 38 of a connector 36. The four connectors 36 thus join the legs 32 to the base 12 of the collapsible wire carrier 10 in a manner which is quick and easy.

As shown in FIG. 2, each of the four connectors 36 used to join the top 24 to the legs 32 fits partially inside one of the downwardly turned lower portion 27 of one of the top members 26 and partially inside an upper portion of one of the legs 32. The upper two openings 38 of each of these four connectors 36 align with the two openings 22 of one of the downwardly turned lower portion 27 of one of the top members 26 so that two fasteners 40 may extend through the openings 28 of a downwardly turned lower portion 27 of one of the top members 26 and extend into the two of the openings 38 of a connector 36. Similarly, the lower two openings 38 of each of these four connectors 36 align with the two openings 34 of one of the legs 32 so that two fasteners 40 may extend through the openings 34 of a leg 34 and extend into the two of the openings 38 of a connector 36. The four connectors 36 thus join the legs 32 to the top 24 of the collapsible wire carrier 10 in a manner which is quick and easy.

Figure 4:
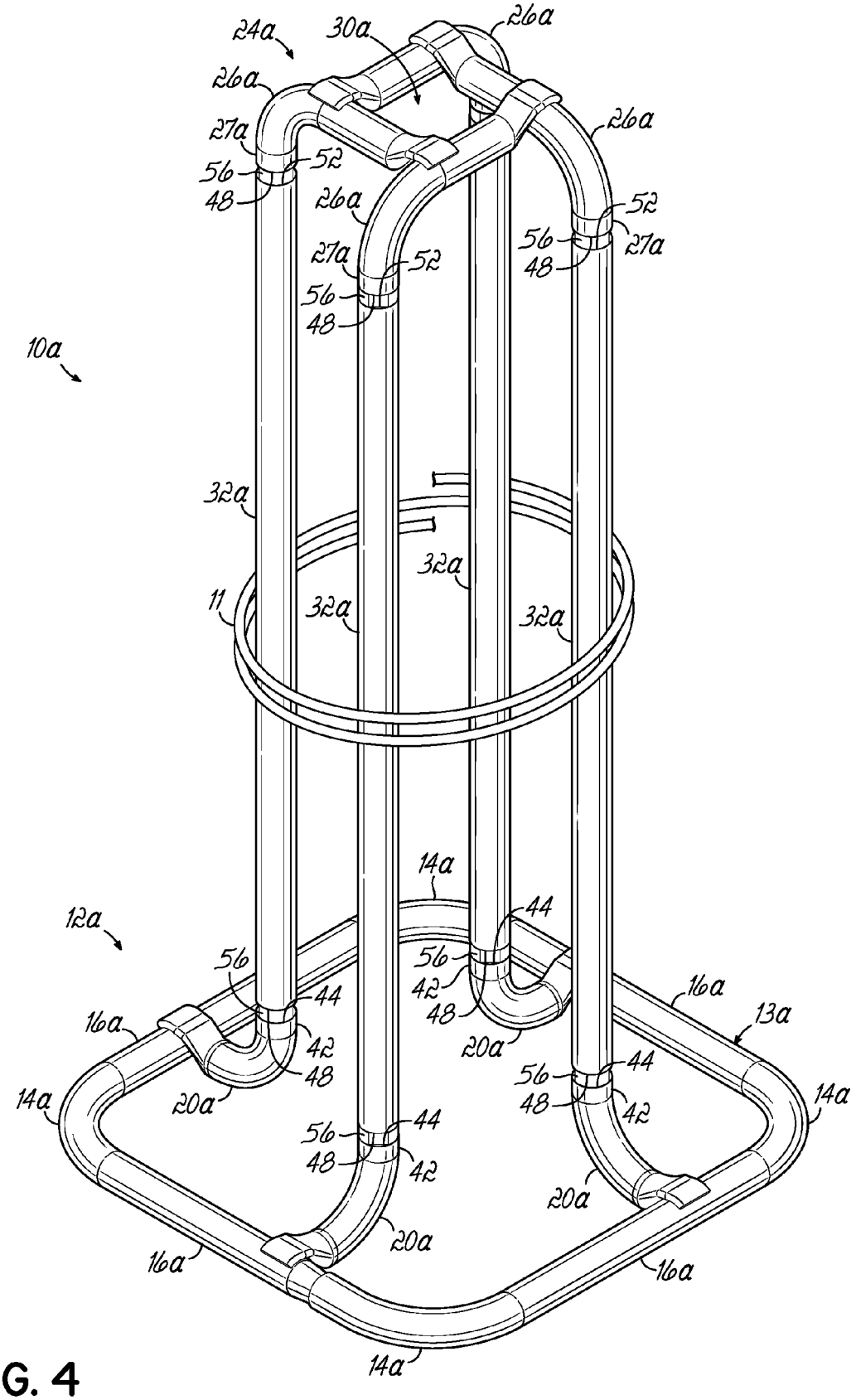
FIG. 4 is a perspective view of another embodiment of collapsible wire carrier in an assembled condition.
Figure 5:
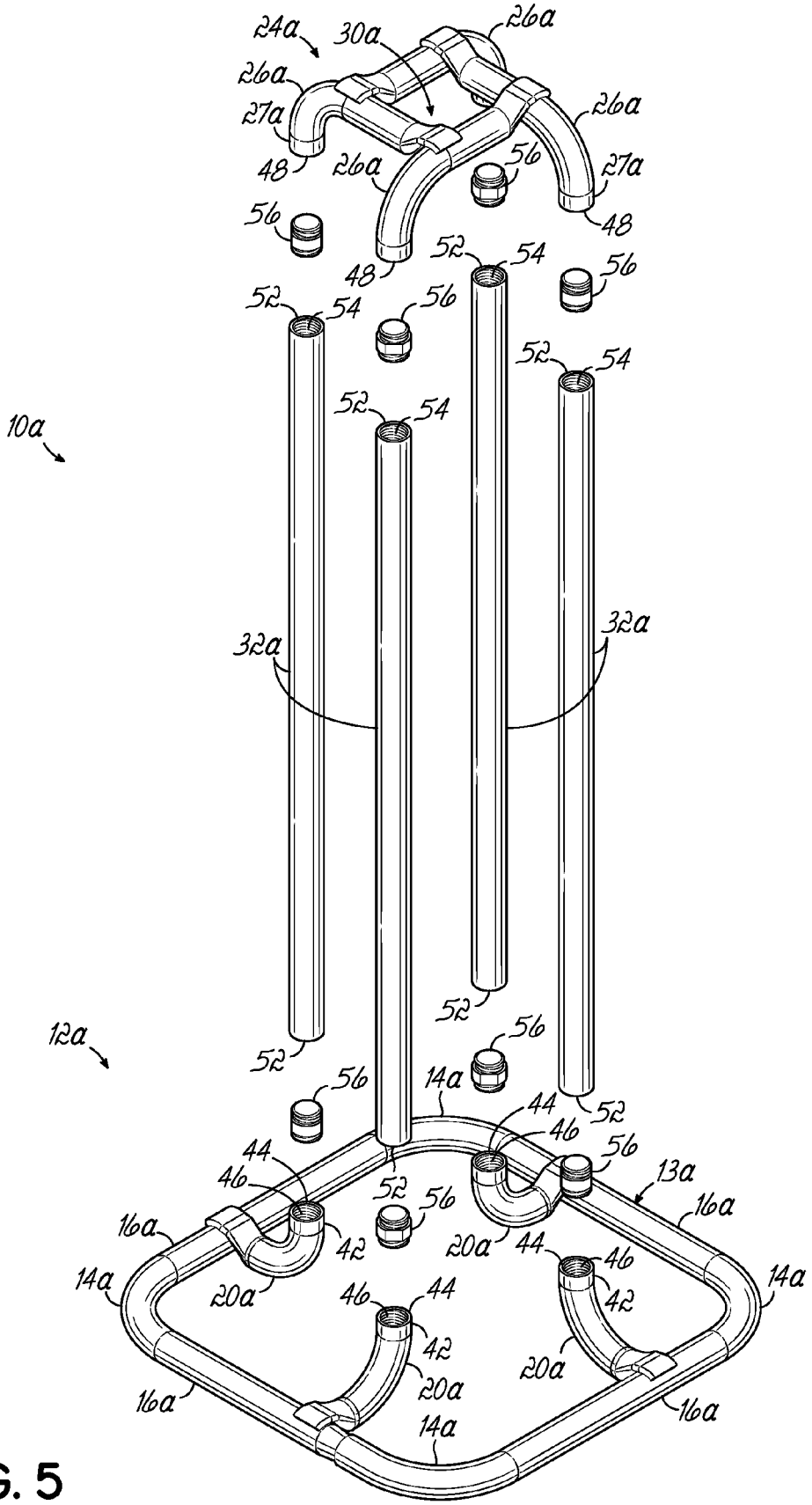
FIG. 5 is a partially disassembled view of the collapsible wire carrier of FIG. 4.
Figure 6:
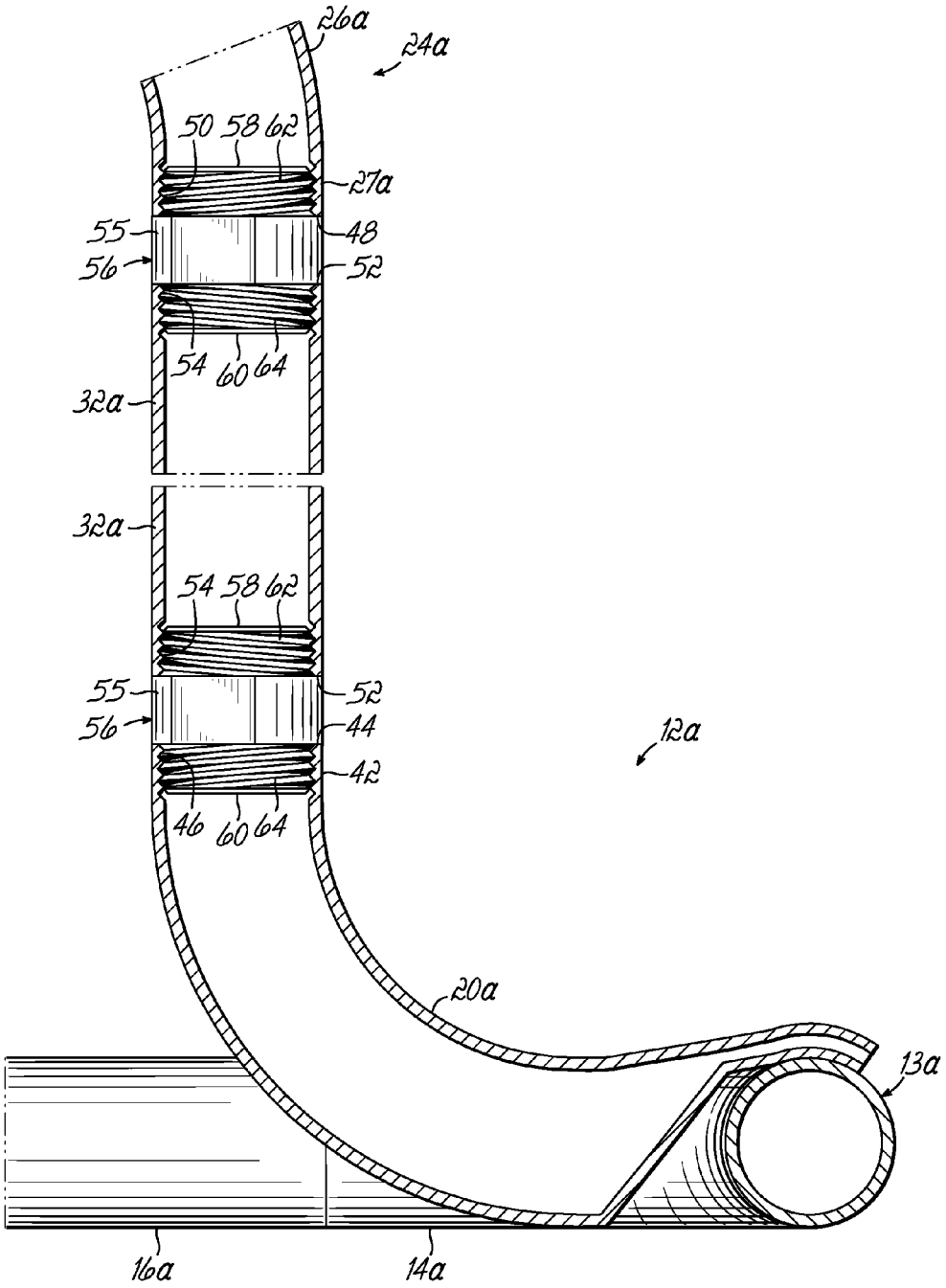
FIG. 6 is an enlarged cross-sectional view of a portion of the collapsible wire carrier of FIGS. 4 and 5.

FIGS. 4-6 illustrate an alternative embodiment of collapsible wire carrier 10*a* for storing and transporting wire 11. The collapsible wire carrier 10*a* comprises a base 12*a* having a generally rectangular base bottom 13*a* comprising four corner pieces 14*a* and four straight side pieces 16*a* (only one being shown per side in FIG. 4). Although the base 12*a* shown in FIG. 4 shows each of the sides 16*a* of the base bottom 13*a* being approximately the same length, they may be any desired lengths. The drawings are not intended to be limiting. Each of the pieces 14*a* , 16*a* of base bottom 13*a* may be tubular and sized to fit together when assembled.

As best shown in FIG. 5, collapsible wire carrier 10*a* further comprises a plurality of tubular base extensions 20*a* secured to the side pieces 16*a* of the base 12*a* such as by welding. Each of the base extensions 20*a* is arched or bowed upwardly and inwardly towards the center of the base bottom 13*a* . As shown in FIG. 5, an upper portion 42 of each base extension 20*a* has a threaded opening 44 comprising internal threads 46. These internal threads 46 are either right or left handed threads for mating with corresponding external threads of one of the connectors in a manner described below.

As best shown in FIG. 5, collapsible wire carrier 10*a* further comprises a top 24*a* comprising four top members 26*a* welded together. Each of the top members 26*a* may be tubular and have a downwardly turned lower portion 27*a* having a threaded opening 48 comprising internal threads 50. The internal threads 50 are either right or left handed threads for mating with corresponding external threads of one of the connectors in a manner described below. Each of the top members 26*a* is welded to one of the other top members 26*a* to create a rectangular opening 30*a* in the top 24*a* , as shown in FIGS. 4 and 5.

As best shown in FIG. 5, collapsible wire carrier 10*a* further comprises four straight tubular legs 32*a* . Each leg 32*a* has at each end a threaded opening 52 comprising internal threads 54. The internal threads 54 are either right or left handed threads for mating with corresponding external threads of one of the connectors in a manner described below.

As best shown in FIG. 5, collapsible wire carrier 10*a* further comprises eight connectors 56. Four of the connectors 56 join upper portions of the legs 32*a* to the top 24*a* of the collapsible wire carrier 10*a* and, particularly, to the downwardly turned portions 27*a* of the top members 26*a* . Four other of the connectors 56 join lower portions of the legs 32*a* to the base 12*a* of the collapsible wire carrier 10*a* and, particularly, to the tubular base extensions 20*a* of base 12*a*.

As shown in FIGS. 5 and 6, each of the connectors 56 is a solid metallic piece having a middle non-threaded portion 55 and first and second threaded ends 58, 60, respectively. Each of the upper or first threaded ends 58 has external threads 62 sized and adapted to mate with the internal threads 54 of the legs 32*a* or the internal threads 46 of a base extension 20*a* or the internal threads 50 of a top member 26*a*.

As shown in FIG. 6, each of the four connectors 56 used to join the base 12*a* to the legs 32*a* fits partially inside one of the base extensions 20*a* and partially inside a lower portion of one of the legs 32*a* . The first or upper portion 58 of the connector 56 is threaded into the threaded opening 52 of one of the legs 32*a* . Similarly, second or lower portion 60 of the connector 56 is threaded into the threaded opening 44 of an upper portion 42 of a base extension 20*a* . The four connectors 56 thus join the legs 32*a* to the base 12*a* of the collapsible wire carrier 10 in a manner which is quick and easy.

As shown in FIG. 6, each of the four connectors 56 used to join the top 24*a* to the legs 32*a* fits partially inside one of the downwardly turned lower portions 27*a* of one of the top members 26*a* and partially inside an upper portion of one of the legs 32*a* . The first or upper portion 58 of the connector 56 is threaded into the threaded opening 48 of one of the downwardly turned portions 27*a* of the top members 26*a* . Similarly, second or lower portion 60 of the connector 56 is threaded into the threaded opening 52 of one of the legs 32*a* . The four connectors 36 thus join the legs 32*a* to the top 24*a* of the collapsible wire carrier 10*a* in a manner which is quick and easy.

Although the connectors are shown having a certain cross-sectional configuration, they may be other sizes or shapes. Similarly, the openings in the pieces of the collapsible wire carrier may be any desired shapes or sizes. Although we have described several embodiments of the invention, we do not intend to be limited except by the scope of the following claims.

We claim:

1. A collapsible wire carrier comprising:

a base having multiple tubular base extensions secured to a rectangular bottom of the base, each of the base extensions being curved and extending towards a center of the base and having a flattened end overlapping the base bottom;

a top comprising multiple tubular members each tubular member having a flattened end overlapping another top member;

multiple legs, each of the legs extending between one of the base extensions and a tubular member of the top, the legs being spaced inwardly from the rectangular bottom of the base so that wire may be wrapped around the legs for storage and may be unwrapped from the carrier by rotating the carrier;

connectors having threaded ends joining each of said legs to said top and said tubular base extensions, each of the legs being removably secured to the base and top of the carrier;

wherein the legs, top and base may be separated from each by removing the connectors.

2. The carrier of claim 1 wherein the legs are tubular.

3. The carrier of claim 1 wherein the legs are straight and tubular.

4. The carrier of claim 1 wherein the carrier has four legs and eight connectors.

5. The carrier of claim 1 wherein the top comprises four tubular members.

6. The carrier of claim 5 wherein each of the connectors has a first threaded end adapted to engage a threaded opening in one of the legs and a second threaded end to engage a threaded opening in one of the base and top.

7. The carrier of claim 1 wherein the openings are circular.

8. The carrier of claim 1 wherein the base has a rectangular bottom portion made of multiple tubular members.

9. The carrier of claim 1 wherein each of the legs has two openings.

10. A collapsible wire carrier comprising:

a base having a generally rectangular base bottom and a plurality of curved base extensions secured to the base bottom, each of the base extensions being arched upwardly and inwardly and having a threaded opening and a flattened end overlapping the base bottom;

a top comprising multiple members secured together, each of the top members having a downwardly curved portion having a threaded opening and a flattened end overlapping another top member;

multiple straight tubular legs, each of the legs being removably secured to the base and top of the carrier with connectors having threaded ends wherein the collapsible wire carrier may be broken into pieces for ease of transportation and wherein the legs are spaced inwardly from the base bottom such that wire may be wrapped around the legs for storage without falling off the base bottom.

11. The carrier of claim 10 wherein each of the connectors is engaged with a threaded opening in one of the base extensions and top members and one of the legs.

12. The carrier of claim 11 wherein the top comprises four tubular members welded together.

13. The carrier of claim 10 wherein the carrier has four legs and eight connectors.

14. The carrier of claim 10 wherein the carrier has at least three legs.

15. A collapsible wire carrier comprising:

a base having a generally rectangular base bottom and four curved base extensions secured to the base bottom, each of the base extensions being arched upwardly and inwardly and having a threaded opening and a flattened end overlapping the base bottom;

a top comprising four curved members welded together, each of the top members having a downwardly curved portion having a threaded opening therein and a flattened end overlapping another top member;

four straight legs spaced inwardly from the base bottom such that wire may be wrapped around the legs for storage without falling off the base and may be unwrapped by rotating the carrier, each of the legs having threaded openings therein;

eight connectors joining the legs to the base extensions and top members, each of the connectors have threaded ends, one of the threaded ends extending into one of the threaded openings in one of the base extensions and top members and the other threaded end extending into one of the threaded openings in one of the legs wherein the legs may be separated from the top and base for shipping the wire carrier by separating the connectors from the top and base and legs.

16. The carrier of claim 15 wherein each of the base extensions is welded to the base bottom.

17. The carrier of claim 16 wherein each of the legs fits into one of the base extensions.

18. The carrier of claim 15 wherein each of the legs is tubular.

* * * * *

UNITED STATES PATENT AND TRADEMARK OFFICE

CERTIFICATE OF CORRECTION

PATENT NO. : 9,120,640 B2
APPLICATION NO. : 13/721220
DATED : September 1, 2015
INVENTOR(S) : Mark J. Janosik et al.

It is certified that error appears in the above-identified patent and that said Letters Patent is hereby corrected as shown below:

IN THE SPECIFICATION

Column 4

Line 54, the "." at the beginning of the line should be after "32a" in the previous line.

IN THE CLAIMS

Column 5

Line 17, after "each", insert the word --other--.

Line 30, "claim 1" should be ---claim 6---.

Signed and Sealed this
Sixteenth Day of February, 2016

Michelle K. Lee

Michelle K. Lee
*Director of the United States Patent and Trademark Office*